US008308363B2

(12) United States Patent
Vogt et al.

(10) Patent No.: US 8,308,363 B2
(45) Date of Patent: Nov. 13, 2012

(54) PACKAGE INTEGRITY INDICATOR FOR CONTAINER CLOSURE

(75) Inventors: Carole Anne Vogt, Budd Lake, NJ (US); Gladys Odette Sierra-Gomez, Woodbridge, NJ (US); Jeffrey Thomas Weber, Lake Zurich, IL (US); Elizabeth A. McDermott, Verona, NJ (US); Douglas H. Philipsen, Hackettstown, NJ (US)

(73) Assignee: Kraft Foods Global Brands LLC, Northfield, IL (US)

( * ) Notice: Subject to any disclaimer, the term of this patent is extended or adjusted under 35 U.S.C. 154(b) by 1231 days.

(21) Appl. No.: 11/500,497

(22) Filed: Aug. 8, 2006

(65) Prior Publication Data

US 2010/0303391 A9 Dec. 2, 2010

Related U.S. Application Data

(63) Continuation-in-part of application No. 11/438,705, filed on May 23, 2006.

(51) Int. Cl.
*B65D 77/10* (2006.01)
*B65D 51/20* (2006.01)

(52) U.S. Cl. ..... 383/5; 220/258.3; 220/359.3; 229/80.5; 229/87.05; 383/203; 383/211; 426/122; 428/42.3

(58) Field of Classification Search ..... 220/359.3, 220/258.3; 383/5, 106, 203–205, 207, 210, 383/211; 428/40.1–40.3; 229/87.05, 87.06, 229/80.5; 426/122, 123
See application file for complete search history.

(56) References Cited

U.S. PATENT DOCUMENTS

| | | | |
|---|---|---|---|
| 811,092 | A | 1/1906 | Roberts |
| 1,065,012 | A | 6/1913 | Watanabe |
| 1,106,721 | A | 8/1914 | Lewis |
| 1,171,462 | A | 2/1916 | Rice |
| 1,791,352 | A | 2/1931 | Colonnese |

(Continued)

FOREIGN PATENT DOCUMENTS

AU 768679 6/2001

(Continued)

OTHER PUBLICATIONS

Reclosure system lengthens food life, Packaging News PPMA Preview, Sep. 2001, p. 40.

(Continued)

*Primary Examiner* — J. Gregory Pickett
*Assistant Examiner* — Ned A Walker
(74) *Attorney, Agent, or Firm* — Fitch, Even, Tabin & Flannery, LLP

(57) ABSTRACT

A resealable closure for packages is provided which has a package integrity feature. The closure includes a two-ply material having an inner film layer and an outer film layer, forming a top of container. The outer film layer has a sealing panel completely covering a first panel and a second panel of the inner film layer. The sealing panel is permanently attached to the first panel and is releasably affixed a portion of the inner film layer around the perimeter of the first panel to form an opening in the top when the sealing panel with affixed first panel is peeled back from the top. The sealing panel is resealable against the top to seal the opening when the sealing panel is moved back against the top. The package integrity feature comprises the second panel of the inner layer which separates from the sealing panel to indicate that the container has been previously opened.

17 Claims, 5 Drawing Sheets

U.S. PATENT DOCUMENTS

| | | | | | |
|---|---|---|---|---|---|
| 1,963,639 | A | | 6/1934 | Ahlquist | |
| 1,978,035 | A | | 10/1934 | Thom | |
| 2,066,495 | A | | 1/1937 | Swift | |
| 2,128,196 | A | | 8/1938 | Vogel | |
| 2,475,236 | A | | 7/1949 | Gollab | |
| 2,554,160 | A | | 5/1951 | Von Gunter | |
| 2,605,897 | A | | 8/1952 | Rundle | |
| 2,684,807 | A | | 7/1954 | Gerrish | |
| 2,965,224 | A | | 12/1960 | Harwood | |
| 3,080,238 | A | | 3/1963 | Howard et al. | |
| 3,127,273 | A | | 3/1964 | Monoham | |
| 3,179,326 | A | | 4/1965 | Underwood et al. | |
| 3,186,628 | A | | 6/1965 | Rohde | |
| 3,187,982 | A | | 6/1965 | Underwood et al. | |
| 3,217,871 | A | | 11/1965 | Lee | |
| 3,235,165 | A | | 2/1966 | Jackson | |
| 3,259,303 | A | | 7/1966 | Repko | |
| 3,260,358 | A | | 7/1966 | Gottily et al. | |
| 3,272,422 | A | | 9/1966 | Miller | |
| 3,311,032 | A | | 3/1967 | Malcom | |
| 3,326,450 | A | | 6/1967 | Langdon | |
| 3,331,501 | A | | 7/1967 | Steward, Jr. | |
| 3,343,541 | A | | 9/1967 | Bellemy, Jr. | |
| 3,373,926 | A | | 3/1968 | Voightman, Sr. et al. | |
| 3,454,210 | A | | 7/1969 | Spiegel et al. | |
| 3,528,825 | A | | 9/1970 | Doughty | |
| 3,570,751 | A | | 3/1971 | Trewella | |
| 3,595,466 | A | | 7/1971 | Rosenburg, Jr. | |
| 3,595,468 | A | | 7/1971 | Repko | |
| 3,618,751 | A | | 11/1971 | Rich | |
| 3,630,346 | A | | 12/1971 | Burnside | |
| 3,651,615 | A | | 3/1972 | Bohner et al. | |
| 3,653,502 | A | | 4/1972 | Beaudoin | |
| 3,687,352 | A | | 8/1972 | Kalajian | |
| 3,740,238 | A | | 6/1973 | Graham | |
| 3,757,078 | A | | 9/1973 | Conti et al. | |
| 3,790,744 | A | | 2/1974 | Bowen | |
| 3,885,727 | A | | 5/1975 | Gilley | |
| 3,905,646 | A | | 9/1975 | Brackmann et al. | |
| 3,909,582 | A | | 9/1975 | Bowen | |
| 3,910,410 | A | | 10/1975 | Shaw | |
| 3,938,659 | A | | 2/1976 | Wardwell | |
| 3,966,046 | A | | 6/1976 | Deutschlander | |
| 3,971,506 | A | | 7/1976 | Roenna | |
| 4,113,104 | A | | 9/1978 | Meyers | |
| 4,156,493 | A | | 5/1979 | Julius | |
| 4,185,754 | A | | 1/1980 | Julius | |
| 4,192,420 | A | | 3/1980 | Worrell et al. | |
| 4,192,448 | A | | 3/1980 | Porth | |
| 4,197,949 | A | | 4/1980 | Carlsson | |
| 4,258,876 | A | | 3/1981 | Ljungerantz | |
| 4,260,061 | A | | 4/1981 | Jacobs | |
| 4,273,815 | A | | 6/1981 | Gifford et al. | |
| 4,306,367 | A | | 12/1981 | Otto | |
| 4,337,862 | A | | 7/1982 | Suter | |
| 4,364,478 | A | | 12/1982 | Tuns | |
| 4,397,415 | A | | 8/1983 | Lisiecki | |
| 4,411,365 | A | | 10/1983 | Horikawa et al. | |
| 4,420,080 | A | | 12/1983 | Nakamura | |
| 4,428,477 | A | | 1/1984 | Cristofolo | |
| 4,464,154 | A | | 8/1984 | Ljungcrantz | |
| 4,488,647 | A | | 12/1984 | Davis | |
| 4,506,488 | A | | 3/1985 | Matt et al. | |
| 4,518,087 | A | | 5/1985 | Goglio | |
| 4,538,396 | A | | 9/1985 | Nakamura | |
| 4,548,824 | A | | 10/1985 | Mitchell et al. | |
| 4,548,852 | A | | 10/1985 | Mitchell | |
| 4,549,063 | A | | 10/1985 | Ang et al. | |
| 4,550,831 | A | | 11/1985 | Whitford | |
| 4,552,269 | A | * | 11/1985 | Chang | 383/211 |
| 4,557,505 | A | | 12/1985 | Schaefer et al. | |
| 4,570,820 | A | | 2/1986 | Murphy | |
| 4,572,377 | A | | 2/1986 | Beckett | |
| 4,608,288 | A | | 8/1986 | Spindler | |
| 4,610,357 | A | | 9/1986 | Nakamura | |
| 4,613,046 | A | | 9/1986 | Kuchenbecker | |
| 4,616,470 | A | | 10/1986 | Nakamura | |
| 4,625,495 | A | | 12/1986 | Holavach | |
| 4,638,911 | A | | 1/1987 | Prohaska | |
| 4,648,509 | A | | 3/1987 | Alves | |
| 4,651,874 | A | | 3/1987 | Nakamura | |
| 4,653,250 | A | | 3/1987 | Nakamura | |
| 4,658,963 | A | | 4/1987 | Jud | |
| 4,667,453 | A | | 5/1987 | Goglio | |
| 4,671,453 | A | | 6/1987 | Cassidy | |
| 4,673,085 | A | | 6/1987 | Badouard et al. | |
| 4,679,693 | A | * | 7/1987 | Forman | 383/203 |
| 4,694,960 | A | | 9/1987 | Phipps et al. | |
| 4,696,404 | A | | 9/1987 | Corella | |
| 4,723,301 | A | * | 2/1988 | Chang | 383/66 |
| 4,738,365 | A | | 4/1988 | Prater | |
| 4,739,879 | A | | 4/1988 | Nakamura | |
| 4,784,885 | A | | 11/1988 | Carespodi | |
| 4,790,436 | A | | 12/1988 | Nakamura | |
| 4,798,295 | A | | 1/1989 | Rausing | |
| 4,798,296 | A | | 1/1989 | Lagerstedt et al. | |
| 4,799,594 | A | | 1/1989 | Blackman | |
| 4,811,848 | A | | 3/1989 | Jud | |
| 4,818,120 | A | | 4/1989 | Addiego | |
| 4,838,429 | A | | 6/1989 | Fabisiewicz et al. | |
| 4,840,270 | A | * | 6/1989 | Caputo et al. | 206/205 |
| 4,845,470 | A | | 7/1989 | Boldt et al. | |
| 4,848,575 | A | * | 7/1989 | Nakamura et al. | 206/449 |
| 4,863,064 | A | | 9/1989 | Dailey, III | |
| 4,865,198 | A | | 9/1989 | Butler | |
| 4,866,911 | A | | 9/1989 | Grindrod et al. | |
| 4,874,096 | A | | 10/1989 | Tessera-Chiesa | |
| 4,876,123 | A | * | 10/1989 | Rivera et al. | 428/34.2 |
| 4,901,505 | A | | 2/1990 | Williams, Jr. | |
| 4,902,142 | A | | 2/1990 | Lammert et al. | |
| 4,917,247 | A | | 4/1990 | Jud | |
| 4,943,439 | A | | 7/1990 | Andreas et al. | |
| 4,972,953 | A | | 11/1990 | Friedman et al. | |
| 4,998,666 | A | * | 3/1991 | Ewan | 229/102 |
| 5,000,320 | A | | 3/1991 | Kuchenbecker | |
| 5,005,264 | A | | 4/1991 | Breen | |
| 5,018,625 | A | | 5/1991 | Focke et al. | |
| 5,029,712 | A | | 7/1991 | O'Brien | |
| 5,040,685 | A | | 8/1991 | Focke et al. | |
| 5,046,621 | A | | 9/1991 | Bell | |
| 5,048,718 | A | | 9/1991 | Nakamura | |
| 5,060,848 | A | * | 10/1991 | Ewan | 229/102 |
| 5,065,868 | A | | 11/1991 | Cornelissen et al. | |
| 5,076,439 | A | | 12/1991 | Kuchenbecker | |
| 5,077,064 | A | | 12/1991 | Hustad et al. | |
| 5,078,509 | A | | 1/1992 | Center et al. | |
| 5,082,702 | A | | 1/1992 | Alband | |
| 5,085,724 | A | | 2/1992 | Focke | |
| 5,096,113 | A | | 3/1992 | Focke | |
| 5,100,003 | A | | 3/1992 | Jud | |
| 5,103,980 | A | | 4/1992 | Kuchenbecker | |
| 5,124,388 | A | | 6/1992 | Pruett et al. | |
| 5,125,211 | A | | 6/1992 | O'Brien et al. | |
| 5,134,001 | A | | 7/1992 | Osgood | |
| 5,158,499 | A | | 10/1992 | Guckenberger | |
| 5,161,350 | A | | 11/1992 | Nakamura | |
| 5,167,974 | A | | 12/1992 | Grindrod et al. | |
| 5,174,659 | A | | 12/1992 | Laske | |
| 5,184,771 | A | | 2/1993 | Jud et al. | |
| 5,197,618 | A | | 3/1993 | Goth | |
| 5,222,422 | A | | 6/1993 | Benner, Jr. et al. | |
| 5,222,813 | A | | 6/1993 | Kopp et al. | |
| 5,294,470 | A | * | 3/1994 | Ewan | 428/41.6 |
| 5,307,988 | A | | 5/1994 | Focke et al. | |
| 5,333,735 | A | | 8/1994 | Focke et al. | |
| 5,344,007 | A | | 9/1994 | Nakamura et al. | |
| 5,352,466 | A | | 10/1994 | Delonis | |
| 5,356,068 | A | | 10/1994 | Moreno | |
| 5,366,087 | A | | 11/1994 | Bane | |
| 5,371,997 | A | | 12/1994 | Kopp et al. | |
| 5,375,698 | A | | 12/1994 | Ewart et al. | |
| 5,381,643 | A | | 1/1995 | Kazaitis et al. | |
| 5,382,190 | A | | 1/1995 | Graves | |
| 5,388,757 | A | | 2/1995 | Lorenzen | |
| 5,405,629 | A | | 4/1995 | Marnocha et al. | |
| 5,407,070 | A | | 4/1995 | Bascos et al. | |
| 5,409,115 | A | | 4/1995 | Barkhorn | |

5,409,116 A 4/1995 Aronsen
5,454,207 A 10/1995 Storandt
5,460,838 A 10/1995 Wermund
5,460,844 A 10/1995 Gaylor
5,461,845 A 10/1995 Yeager
5,464,092 A 11/1995 Seeley
5,470,015 A 11/1995 Jud
5,489,060 A 2/1996 Godard
5,499,757 A 3/1996 Back
5,503,858 A 4/1996 Reskow
5,505,305 A 4/1996 Scholz et al.
5,515,965 A 5/1996 Boldrini et al.
5,519,982 A 5/1996 Herber et al.
5,520,939 A 5/1996 Wells
5,524,759 A 6/1996 Herzberg et al.
5,531,325 A 7/1996 Delflander et al.
5,538,129 A 7/1996 Chester et al.
5,550,346 A 8/1996 Andriash et al.
5,558,438 A 9/1996 Warr
5,582,342 A 12/1996 Jud
5,582,853 A 12/1996 Marnocha et al.
5,582,887 A 12/1996 Etheredge
5,591,468 A 1/1997 Stockley, III et al.
5,630,308 A 5/1997 Guckenberger
5,633,058 A 5/1997 Hoffer et al.
5,637,369 A 6/1997 Stewart
5,647,100 A 7/1997 Porchia et al.
5,647,506 A 7/1997 Julius
5,664,677 A 9/1997 O'Connor
5,688,394 A * 11/1997 McBride et al. ..... 206/233
5,688,463 A 11/1997 Robichaud et al.
5,702,743 A 12/1997 Wells
5,709,479 A 1/1998 Bell
5,725,311 A 3/1998 Ponsi et al.
D394,605 S 5/1998 Skiba et al.
5,749,657 A 5/1998 May
5,770,283 A 6/1998 Gosselin et al.
5,791,465 A 8/1998 Niki et al.
5,795,604 A 8/1998 Wells et al.
5,820,953 A 10/1998 Beer et al.
5,833,368 A 11/1998 Kaufman
5,855,435 A 1/1999 Chiesa
5,862,101 A 1/1999 Haas et al.
5,873,483 A 2/1999 Gortz et al.
5,873,607 A 2/1999 Waggoner
5,882,116 A 3/1999 Backus
5,885,673 A 3/1999 Light et al.
5,906,278 A 5/1999 Ponsi et al.
5,908,246 A 6/1999 Arimura
5,928,749 A 7/1999 Forman
5,938,013 A 8/1999 Palumbo et al.
5,939,156 A 8/1999 Rossi et al.
5,945,145 A * 8/1999 Narsutis et al. ..... 426/123
5,956,794 A 9/1999 Skiba et al.
5,993,962 A 11/1999 Timm et al.
5,996,797 A 12/1999 Flaig
5,997,177 A 12/1999 Kaufman
6,015,934 A 1/2000 Lee et al.
6,026,953 A * 2/2000 Nakamura et al. ..... 206/233
6,028,289 A 2/2000 Robichaud et al.
6,029,809 A 2/2000 Skiba et al.
6,037,381 A 3/2000 Beer
6,056,141 A 5/2000 Navarini et al.
6,060,095 A 5/2000 Scrimager
6,065,591 A 5/2000 Dill et al.
6,066,437 A 5/2000 Kosslinger
6,076,969 A 6/2000 Jaisle et al.
6,077,551 A 6/2000 Scrimager
6,099,682 A 8/2000 Krampe et al.
6,113,271 A * 9/2000 Scott et al. ..... 383/211
6,125,614 A 10/2000 Jones et al.
6,126,009 A 10/2000 Shiffler et al.
6,126,317 A 10/2000 Anderson et al.
6,152,601 A 11/2000 Johnson
6,164,441 A * 12/2000 Guy et al. ..... 206/210
6,213,645 B1 4/2001 Beer
6,228,450 B1 5/2001 Pedrini
D447,054 S 8/2001 Hill
6,273,610 B1 8/2001 Koyama et al.
6,279,297 B1 8/2001 Latronico
6,296,884 B1 10/2001 Okerfund
6,299,355 B1 10/2001 Schneck
6,309,104 B1 10/2001 Koch et al.
6,309,105 B1 * 10/2001 Palumbo ..... 383/211
6,318,894 B1 11/2001 Derenthal
6,352,364 B1 3/2002 Mobs
6,364,113 B1 4/2002 Faasse, Jr. et al.
6,365,255 B1 4/2002 Kittel et al.
6,383,592 B1 5/2002 Lowry et al.
6,402,379 B1 6/2002 Albright
6,420,006 B1 7/2002 Scott
6,427,420 B1 8/2002 Olivieri et al.
6,428,867 B1 8/2002 Scott et al.
6,446,811 B1 9/2002 Wilfong, Jr.
6,450,685 B1 9/2002 Scott
6,457,585 B1 10/2002 Huffer et al.
6,461,043 B1 10/2002 Healy et al.
6,461,708 B1 10/2002 Dronzek
6,471,817 B1 10/2002 Emmert
6,476,743 B1 11/2002 Brown et al.
6,482,867 B1 11/2002 Kimura et al.
6,502,986 B1 1/2003 Bensur et al.
6,517,243 B2 2/2003 Huffer et al.
6,539,691 B2 4/2003 Beer
6,554,134 B1 4/2003 Guibert
6,563,082 B2 5/2003 Terada et al.
6,589,622 B1 7/2003 Scott
6,592,260 B1 7/2003 Randall et al.
6,594,872 B2 7/2003 Cisek
6,621,046 B2 9/2003 Kaji
6,669,046 B1 12/2003 Sawada et al.
6,691,886 B1 2/2004 Berndt et al.
6,698,928 B2 3/2004 Miller
6,726,054 B2 4/2004 Fagen et al.
6,726,364 B2 4/2004 Perell et al.
6,746,743 B2 6/2004 Knoerzer et al.
6,750,423 B2 6/2004 Tanaka et al.
6,767,604 B2 7/2004 Muir, Jr. et al.
6,815,634 B2 11/2004 Sonoda et al.
6,852,947 B2 2/2005 Tanaka
6,865,860 B2 3/2005 Arakawa et al.
6,889,483 B2 5/2005 Compton et al.
6,918,532 B2 7/2005 Sierra-Gomez et al.
6,929,400 B2 8/2005 Razeti et al.
6,951,999 B2 10/2005 Monforton et al.
6,983,875 B2 1/2006 Emmott
7,007,423 B2 3/2006 Andersson et al.
7,021,827 B2 4/2006 Compton et al.
7,032,757 B2 4/2006 Richards et al.
7,040,810 B2 5/2006 Steele
7,048,441 B2 5/2006 Pape
7,051,877 B2 5/2006 Lin
7,165,888 B2 1/2007 Rodick
7,172,779 B2 2/2007 Castellanos et al.
7,207,719 B2 4/2007 Marbler et al.
7,213,710 B2 5/2007 Cotert
7,228,968 B1 6/2007 Burgess
7,254,873 B2 8/2007 Stolmeier et al.
7,261,468 B2 8/2007 Schneider et al.
7,262,335 B2 8/2007 Motsch et al.
7,302,783 B2 12/2007 Cotert
7,344,744 B2 * 3/2008 Sierra-Gomez et al. ..... 426/119
7,350,688 B2 4/2008 Sierra-Gomez et al.
7,351,458 B2 4/2008 Leighton
7,371,008 B2 * 5/2008 Bonenfant ..... 383/5
7,404,487 B2 7/2008 Kumakura et al.
7,422,142 B2 9/2008 Arippol
7,470,062 B2 12/2008 Moteki et al.
7,475,781 B2 1/2009 Kobayashi
7,516,599 B2 4/2009 Doll
7,533,773 B2 5/2009 Aldridge et al.
7,600,641 B2 10/2009 Burgess
7,708,463 B2 5/2010 Sampaio Camacho
7,717,620 B2 5/2010 Hebert et al.
7,758,484 B2 7/2010 Peterson
7,858,901 B2 12/2010 Krishnan et al.
7,971,718 B2 7/2011 Aldridge
8,002,941 B2 8/2011 Exner et al.

| | | | |
|---|---|---|---|
| 2001/0000480 | A1 | 4/2001 | Stagg et al. |
| 2002/0068668 | A1 | 6/2002 | Chow et al. |
| 2003/0019780 | A1 | 1/2003 | Parodi et al. |
| 2003/0039412 | A1 | 2/2003 | Rodick |
| 2003/0047695 | A1 | 3/2003 | Zik et al. |
| 2003/0051440 | A1 | 3/2003 | Chow et al. |
| 2003/0118255 | A1 | 6/2003 | Miller |
| 2003/0127352 | A1 | 7/2003 | Buschkiel et al. |
| 2003/0183637 | A1 | 10/2003 | Zappa |
| 2003/0183643 | A1 | 10/2003 | Fagen et al. |
| 2003/0210838 | A1 | 11/2003 | Steele |
| 2003/0223656 | A1 | 12/2003 | Razeti et al. |
| 2004/0011677 | A1 | 1/2004 | Arakawa et al. |
| 2004/0035719 | A1 | 2/2004 | Ebbers et al. |
| 2004/0060974 | A1 | 4/2004 | Dacey |
| 2004/0062838 | A1 | 4/2004 | Castellanos et al. |
| 2004/0067326 | A1 | 4/2004 | Knoerzer et al. |
| 2004/0083680 | A1 | 5/2004 | Compton et al. |
| 2004/0091184 | A1 | 5/2004 | Miller |
| 2004/0112010 | A1 | 6/2004 | Richards et al. |
| 2004/0150221 | A1 | 8/2004 | Brown |
| 2004/0175060 | A1 | 9/2004 | Woodham et al. |
| 2004/0180118 | A1 | 9/2004 | Renger et al. |
| 2004/0206637 | A1* | 10/2004 | Sierra-Gomez et al. ..... 206/1.5 |
| 2005/0000965 | A1 | 1/2005 | Boardman |
| 2005/0084186 | A1 | 4/2005 | Caris |
| 2005/0117819 | A1 | 6/2005 | Kingsford et al. |
| 2005/0220371 | A1 | 10/2005 | Machacek |
| 2005/0247764 | A1 | 11/2005 | Sierra-Gomez |
| 2005/0276525 | A1 | 12/2005 | Hebert |
| 2005/0276885 | A1 | 12/2005 | Bennett |
| 2006/0018569 | A1 | 1/2006 | Bonenfant |
| 2006/0066096 | A1 | 3/2006 | Kan |
| 2006/0124494 | A1 | 6/2006 | Clark, Jr. et al. |
| 2006/0144911 | A1* | 7/2006 | Sierra-Gomez et al. ... 229/123.1 |
| 2006/0171611 | A1 | 8/2006 | Rapparini |
| 2006/0199717 | A1 | 9/2006 | Marbler et al. |
| 2006/0257056 | A1 | 11/2006 | Miyake et al. |
| 2006/0257599 | A1 | 11/2006 | Exner |
| 2007/0023435 | A1* | 2/2007 | Sierra-Gomez et al. ... 220/359.2 |
| 2007/0023436 | A1* | 2/2007 | Sierra-Gomez et al. ... 220/359.2 |
| 2007/0275133 | A1* | 11/2007 | Sierra-Gomez et al. ..... 426/122 |
| 2008/0037911 | A1 | 2/2008 | Cole et al. |
| 2008/0041750 | A1 | 2/2008 | Kohlweyer |
| 2008/0053861 | A1 | 3/2008 | Mellin |
| 2008/0156861 | A1* | 7/2008 | Sierra-Gomez et al. ..... 229/214 |
| 2008/0240627 | A1* | 10/2008 | Cole et al. ..... 383/204 |
| 2009/0028472 | A1 | 1/2009 | Andersson et al. |

FOREIGN PATENT DOCUMENTS

| | | |
|---|---|---|
| AU | 2002334419 | 5/2003 |
| AU | 2004295316 | 6/2005 |
| AU | 2005254459 | 12/2005 |
| BR | DI55008852 F | 11/2001 |
| BR | DI62020307 F | 4/2003 |
| DE | 9014065 | 4/1991 |
| DE | 4134567 | 10/1991 |
| DE | 4241423 | 6/1994 |
| DE | 19738411 | 3/1999 |
| DE | 19822328 | 11/1999 |
| EP | 388310 | 3/1990 |
| EP | 0474981 | 3/1992 |
| EP | 0488967 | 6/1992 |
| EP | 0546369 | 6/1993 |
| EP | 0447636 | 3/1994 |
| EP | 0608909 | 8/1994 |
| EP | 0613824 | 9/1994 |
| EP | 0629561 | 12/1994 |
| EP | 0661154 | 7/1995 |
| EP | 0667828 | 8/1995 |
| EP | 0669204 | 8/1995 |
| EP | 0752375 | 8/1997 |
| EP | 0796208 | 9/1997 |
| EP | 0758993 | 3/1998 |
| EP | 0905048 | 3/1999 |
| EP | 0744357 | 10/2000 |
| EP | 1046594 | 10/2000 |
| EP | 1056066 | 11/2000 |
| EP | 1449789 | 2/2003 |
| EP | 1350741 | 8/2003 |
| EP | 1375380 | 1/2004 |
| EP | 1382543 | 1/2004 |
| EP | 1437311 | 7/2004 |
| EP | 1457424 | 9/2004 |
| EP | 1477425 | 11/2004 |
| EP | 1488936 | 12/2004 |
| EP | 1086906 | 5/2005 |
| EP | 1608567 | 12/2005 |
| EP | 1609737 | 12/2005 |
| EP | 1609737 | 1/2006 |
| EP | 1619137 | 1/2006 |
| EP | 1637472 | 3/2006 |
| EP | 1697230 | 9/2006 |
| EP | 1712468 | 10/2006 |
| EP | 1770025 | 4/2007 |
| EP | 1608567 | 7/2007 |
| EP | 1755980 | 2/2008 |
| EP | 1858776 | 10/2008 |
| EP | 1712488 | 12/2008 |
| EP | 1846306 | 3/2009 |
| EP | 1468936 | 10/2009 |
| FR | 1327914 | 4/1963 |
| FR | 2674509 | 2/1995 |
| FR | 2766794 | 2/1999 |
| FR | 2783512 | 3/2000 |
| GB | 2276095 | 9/1994 |
| JP | 60080405 | 5/1985 |
| JP | 62-171479 | 10/1987 |
| JP | 62171479 | 10/1987 |
| JP | 63-22370 | 1/1988 |
| JP | 63022370 | 1/1988 |
| JP | 9150872 | 6/1997 |
| JP | 09156677 | 6/1997 |
| JP | 09156677 A * | 6/1997 |
| JP | 10059441 | 3/1998 |
| JP | 10129685 | 5/1998 |
| JP | 1998152179 | 9/1998 |
| JP | 11198977 | 7/1999 |
| JP | 2000335542 | 12/2000 |
| JP | 2001114357 | 4/2001 |
| JP | 1200325224 | 1/2003 |
| JP | 2003072774 | 3/2003 |
| JP | 2006062712 | 3/2006 |
| JP | 2007045434 | 2/2007 |
| WO | 8606350 | 11/1986 |
| WO | 9411270 | 5/1994 |
| WO | 9532902 | 12/1995 |
| WO | 9725200 | 7/1997 |
| WO | 0140073 | 6/2001 |
| WO | 0140073 A1 | 6/2001 |
| WO | 02064365 | 8/2002 |
| WO | 02066341 | 8/2002 |
| WO | 03013976 | 2/2003 |
| WO | 03037727 | 5/2003 |
| WO | 03059776 | 7/2003 |
| WO | 2005056420 | 6/2005 |
| WO | 2005110042 | 11/2005 |
| WO | 2005110865 | 11/2005 |
| WO | 2005110876 | 11/2005 |
| WO | 2005110885 | 11/2005 |
| WO | 2005120989 | 12/2005 |
| WO | 2005123535 | 12/2005 |
| WO | 2006055128 | 5/2006 |
| WO | 2007090419 | 8/2007 |

OTHER PUBLICATIONS

Patent Abstracts of Japan, vol. 1997 No. 10, Oct. 31, 1997 & JP09156677 A (Fuji Seal Col Ltd.), (Jul. 6, 1997) abstract in English and 7 figures.

"Elite Edam Cheese", Mintel gnpd, Dec. 3, 2001, Mintel Publishing.

"New Easy Peel Cheese Packaging", Mintel gnpd, Aug. 10, 2001, Mintel Publishing.

"Cheese Range", Mintel gnpd, Jan. 26, 2001, Mintel Publishing.

"Soft Bread Sticks", Mintel gnpd, Mar. 20, 1998, Mintel Publishing.

"New on the Shelf—Product Instructions and Packaging Trends", Circle Reader Service Card No. 93, Aug. 1998, Baking & Snack.

Reseal-it. [Homepage of Macfarlane Group] [Online] 2005. Available at: http//www.reseal-it.se [accessed Mar. 14, 2005].
Machinery Update, Mar./Apr. 2002, pp. 59-60.
Giant Baby Wipes package, item No. 80203-91, resealable packing having die cut-out portions (tabs) which remain affixed to the top of the package after label is withdrawn from the top, whereby tamper evidence is indicated by a misalignment of the die cut-out portions with the holes formed in the label.
Reseal-It. Web page Internet print out. (accessed Mar. 14, 2005).
Derrien, Y.; European Search Report, PCT/US2011/037054 dated Sep. 14, 2011; 2 pgs.
Derrien, Y.; European Search Report, PCT/US2011/037010 dated Sep. 14, 2011; 3 pgs.
Derrien, Y.; European Search Report, PCT/US2011/036998 dated Sep. 14, 2011; 3 pgs.
Excerpts of Prosecution History of U.S. Appl. No. 10/414,502.
Excerpts of Prosecution History of U.S. Appl. No. 11/029,626.
Excerpts of Prosecution History of U.S. Appl. No. 10/897,712.
Excerpts of Prosecution History of U.S. Appl. No. 11/029,651.
Excerpts of Prosecution History of U.S. Appl. No. 12/118,935.
Excerpts of Prosecution History of U.S. Appl. No. 11/438,705.
Excerpts of Prosecution History of U.S. Appl. No. 11/616,386.
Excerpts of Prosecution History of U.S. Appl. No. 11/693,751.
Excerpts of Prosecution History of U.S. Appl. No. 12/179,103.
Excerpts of Prosecution History of U.S. Appl. No. 11/193,613.
Excerpts of Prosecution History of U.S. Appl. No. 11/193,614.
"margin," Merriam-Webster Online Dictionary, 2010. Merriam-Webster [online], retrieved on May 6, 2010. Retrieved from the internet: URL:>http://www.merriam-webster.com/dictionary/margin>.
English Translation of Japanese Official Notice of Rejection mailed on Feb. 14, 2012 in JP Application No. 2009-172352, 3 pages.
English Translation of JP 1998-152179 published Sep. 6, 1996.
English Translation of JP 2001-114357 published Apr. 24, 2001.
English Translation of JP 2083-26224 published Jan. 29, 2003.
English Transiation of JP H09-158677 published on Jun. 17, 1997.
English Translation of JP S60-80405 published Aug. 5, 1985.
European Packaging Pack Report, NR.5 Mai 2001, 6 pages.
Fuji Packaging GmbH Fachpack brochure, Oct. 11-12, 2001, 2 pages.
Machinery Update, Mar./Apr. 2002, pp. 56-62.
Machinery Update, Sep./Oct. 2001, pp. 46-47.
Opposition to EP1679269 filed by Awapatent AB, Heisingborg, Sweden. May 2, 2012.
Opposition to EP1679269 filed by Bahlse GmbH and Co. KG, Apr. 30, 2012.
Reclosure System Lengthens Food life, Packaging News, Sep. 7, 2001, 2 pages.

* cited by examiner 11
12
13
20
21
22
23
24
26
28
30
32
42

PACKAGE INTEGRITY INDICATOR FOR CONTAINER CLOSURE

This application is a continuation-in-part of U.S. patent application Ser. No. 11/438,705, filed May 23, 2006.

FIELD OF THE INVENTION

The present invention relates to a resealable closure for packages storing articles and, more particularly, resealable closures for packages having a package integrity indicator.

BACKGROUND OF THE INVENTION

Some containers for food products, such as cookies and other snacks, typically include an outer wrapper. In one type of container, the wrapper surrounds a frame which acts as a tray to hold the food product and to protect the food product from damage. Other food products come packaged in plastic trays, such as thermoform trays which are sealed on the top using some type of lidding material. One recent advancement in the art of food container closures includes a resealable closure disclosed in U.S. Pat. No. 6,918,532 (hereinafter the "'532 patent"), herein incorporated by reference, which discloses a wrapper which forms a top of the container which has an access opening covered by a resealable sealing panel.

In the packaging art, different methods have been used to indicate whether a package has been previously opened or whether the integrity of the package has been compromised, often referred to in the art as "tamper-evident." For example, U.S. Patent Application Publication No. 2005/0247764, herein incorporated by reference, discloses means for indicating package integrity using die-cut elongated strips running adjacent to the opening in a sealing area which is defined as the area around the opening of the container, under the sealing panel, and U.S. patent application Ser. No. 11/438,705, herein incorporated by reference, discloses a package integrity indicator in the form of at least one flap or elongated strip which terminates at an opening covered by a closure, where the flap or elongated strip falls into a container sealed with the closure after the container has been opened for the first time.

There is a need for improvements in the art for package integrity indicators for a resealable closure, preferably suitable for use with a resealable closure for containers or packages containing food items.

SUMMARY OF THE INVENTION

The present invention generally relates to a resealable closure for a container formed from a two-ply material which has a package integrity indicator in the form of a panel or flap which terminates at an opening covered by the closure, wherein the panel or flap falls into the container after the container has been opened for a first time.

The present invention, in one form, comprises a package integrity indicating closure comprising an at least two-ply material comprising a first film layer adhesively joined to a second film layer. A first tear line formed into the first film layer, defines a first panel for providing an access opening through the first film layer when separated from the first film layer along the first tear line, and a second tear line formed into the first layer and terminating at the first tear line to thereby define a second panel for indicating an initial opening of the closure when the second panel is separated from the first panel along the first layer tear line. The second film layer has a second layer tear line defining a sealing panel which completely covers the first panel and the second panel of the first film layer. A releasable adhesive releasably adheres the sealing panel to the first film layer such that the sealing panel is separated from the first film layer and the second panel to expose the access opening and to provide a visual indication that the closure has been opened after the sealing panel has been peeled back from the first film layer for a first time.

The second film layer may comprise a see through window portion lying over the second panel of the first layer such that the second panel is visible therethrough prior to the closure being opened for a first time.

The integrity indicating closure for a container may comprise a two-ply material forming a top of the container in which the top is formed to provide an access opening into the container and a flap located adjacent the access opening. A sealing panel of the outer layer is adhesively sealed to the top around the opening such that the flap is visible through a window portion of the sealing panel. The sealing panel is resealably sealed to the inner layer around the opening and the sealing panel is releasable from the top and is separable from the flap by pulling the sealing panel back in a peeling direction and reclosable against the top to seal the opening when the sealing panel is moved back against the top, whereby, after closing, the flap is separated from the sealing panel, and thereby observable through the window portion as not being attached to the sealing panel.

In alternative further embodiments, the flap is integrally formed with the inner layer and the flap is spaced from opposed sides of the opening. The outer layer may be composed of a material allowing visual perception of the flap of the inner layer.

The present invention, in another form thereof, concerns an integrity indicating food container comprising a tray and an at least two-ply material comprising an inner layer adhesively joined to an outer layer to form a top over the tray. The top is formed to provide an access opening for access to food items disclosed in the tray. The inner layer has a first panel and a second panel. The outer layer has a sealing panel formed therein which completely covers the first panel and covers the second panel of the inner layer. The first panel and the sealing panel are permanently joined to each other to form the access opening into the container. A releasable adhesive is provided on either or both the inner layer on a perimeter outside the first panel or on the sealing panel which lies thereover, for adhering the sealing panel to the inner layer and the second panel. The sealing panel is releasable from the inner layer and separable from the second panel by pulling the sealing panel back in a peeling direction and reclosable against the top to seal the opening when the sealing panel is moved back against the top, whereby after closing, the second panel is separated from the outer layer.

In one form, the container includes a see through window portion formed in the sealing panel, adjacent the second panel, such that the second panel is viewable through the window portion, prior to the container being opened for a first time, thus indicating package integrity as not having being previously opened. After the container has been opened for a first time, and subsequently resealed, the absence of the second panel being adhered to the sealing panel will be observable through the window portion, thus indicating package integrity status as having been previously opened.

Food items disposable in the container may include cookies, crackers, peanuts, cheese, sliced meats and semi-solid foods.

Other features and advantages of the present invention are stated in or apparent from detailed descriptions of the presently preferred embodiments of the invention found hereinbelow.

DETAILED DESCRIPTION

Figure 1:
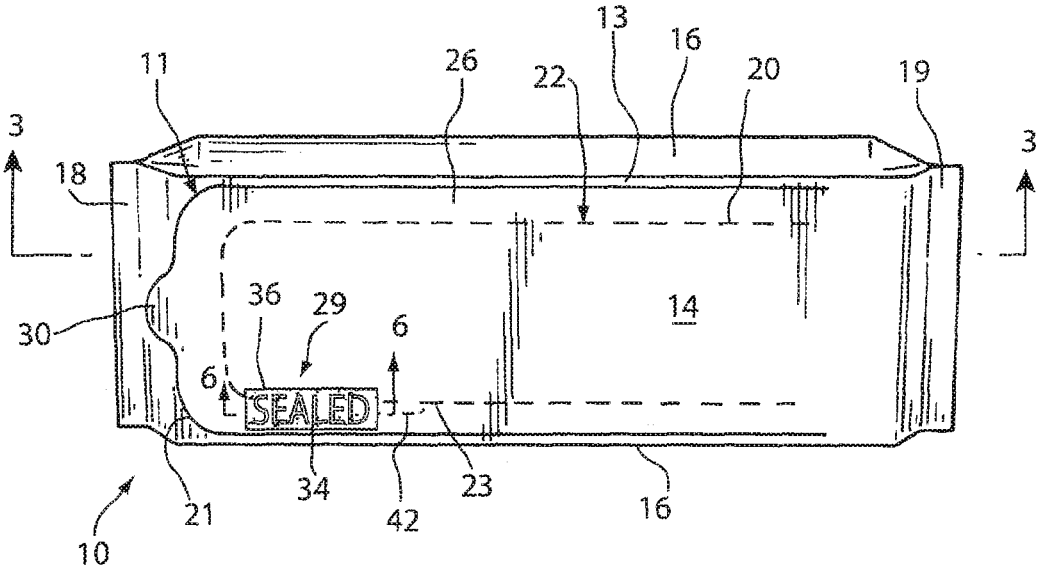
FIG. 1 is a perspective view of a package including an exemplary closure prior to an initial opening, according to the present invention.

Referring to the Figures, and in particular FIGS. 1-9, there is shown package 10 with closure 11 which incorporates a package integrity feature. Package 10 includes a two-ply wrapper comprising a first, inner film layer 12 and a second, outer film layer 13, forming a top or upper surface 14, sides 16, lower surface (not shown), and crimped ends 18, 19. The inner film layer 12 and outer film layer 13 are formed from a polymeric film or other flexible material that has been cut, folded or otherwise pressed to define an inner space or receptacle for receiving the desired product, such as food items, to be provided within the package 10. Package 10 can be used to store and distribute food items such as cookies, crackers, candy or other items. The outer film layer 13 may include graphics or other indicia to identify the contents of the package 10.

Advantageously, the inner film layer 12 is coextensively formed and adhesively joined to the outer film layer 13. During the manufacturing of the package 10, the first, inner film layer 12 is die cut on its side via first tear line 20 and second tear line 23, and outer film layer 13 is die cut on it side via a third tear line 21, as disclosed in U.S. Patent Application Publication No. 2005/0276525, herein incorporated by reference.

The first tear line 20 is formed as a continuous tear line to define a first panel 22. The second tear line 23 forms a second integrity indicating panel 42. The first panel 22 can be separated from the remainder of the inner film layer 12 to expose an opening 24 (FIG. 2*a* and FIG. 4), whereby access to the contents of the package 10 may be gained. The second panel 42 remains integrally joined to the inner film layer 12 at end 44, even after the package is opened, and the remainder falls down, only into the opening 24.

The third tear line 21 defines sealing panel 26 of the outer film layer 13. The sealing panel 26 extends beyond the periphery of the first tear line 20 and the second tear line 23 adjacent to the opening 24, so that the sealing panel 26 completely covers and extends beyond the perimeters of both the first panel 22 and the second panel 42. As a result, sealing panel 26 completely covers both the first panel 22 and the second panel 42.

The side of the sealing panel 26 which faces the inner film layer 12 is coated with a releasable adhesive 28 (see FIGS. 2*b*-5) so that the sealing panel 26 may be resealably secured to the inner film layer 12 at a portion adjacent the first panel 22. Alternatively or along with releasable adhesive 28, releasable adhesive can be coated on the inner film layer 12 along the outside perimeter of the first panel 22. The releasable adhesive can be any pressure sensitive adhesive which allows resealing and includes, but is not limited to, the adhesives disclosed in U.S. patent application Ser. No. 11/029,626, herein incorporated by reference. The sealing panel 26 is provided with a tab 30 or other gripping feature which is not coated with adhesive 28 so that the sealing panel 26 may be peeled back from the inner film layer 12 to open the package 10.

Advantageously, the sealing panel 26 has a see through window portion 29 which lies over the second panel 42 of the inner film layer 12 prior to the package 10 being opened for a first time. The see through window portion 29 is transparent or essentially transparent, thereby permitting one to visually observe the second panel 42 attached thereto prior to the package 10 being opened for a first time, and to observe the absence of second panel 42 attached to the sealing panel 26, after the package 10 has been opened, to indicate package integrity as disclosed in greater detail below.

Figures 3, 4, 5:
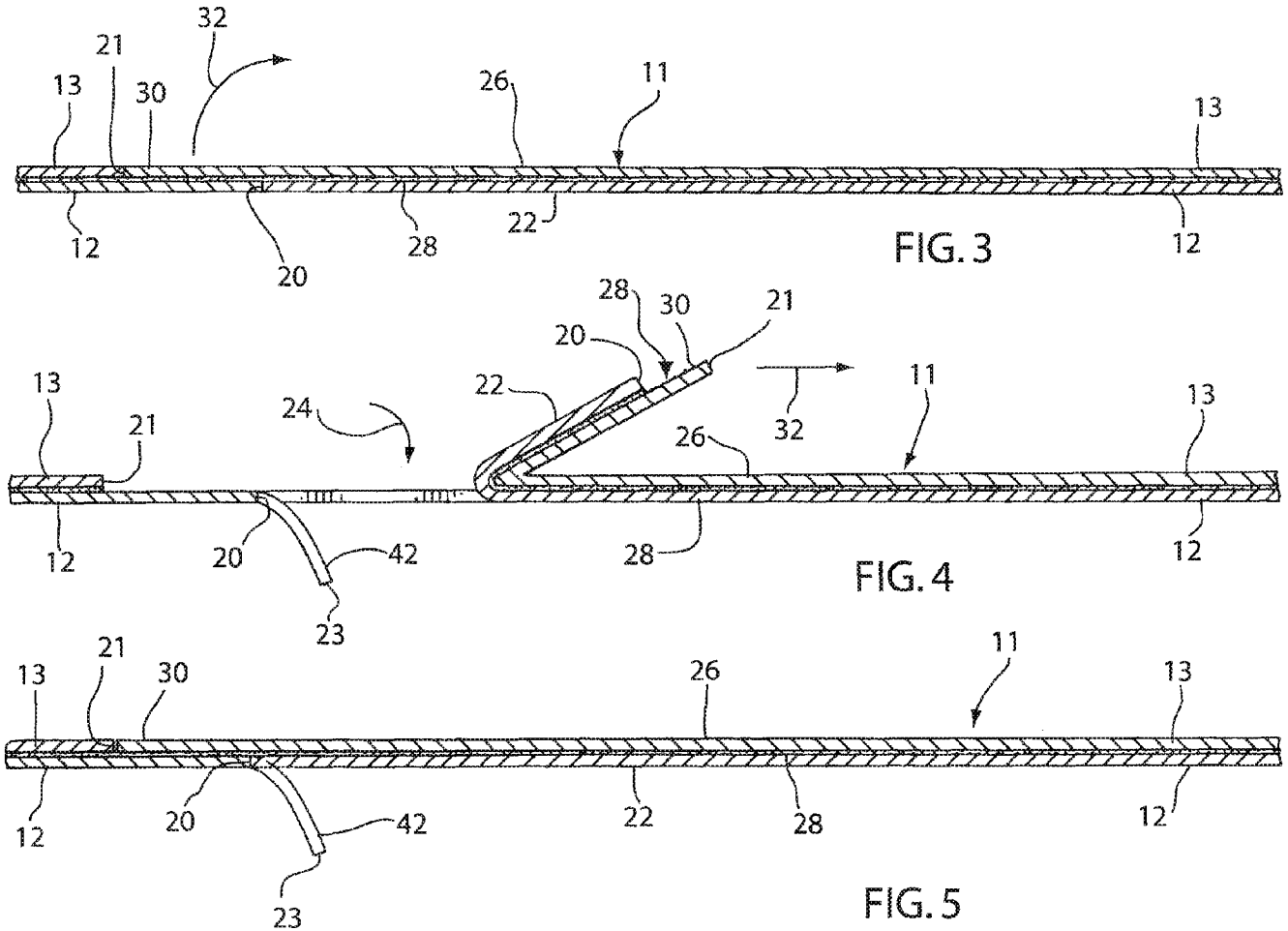
FIG. 3 is a cross-sectional view of the closure of FIG. 1, taken along line 3-3.
FIG. 4 is a cross-sectional view of the closure similar to FIG. 3, depicting an initial opening of the closure.
FIG. 5 is a cross-sectional view of the closure similar to FIG. 3, depicting a resealed configuration of the closure after the initial opening.
Figure 7:
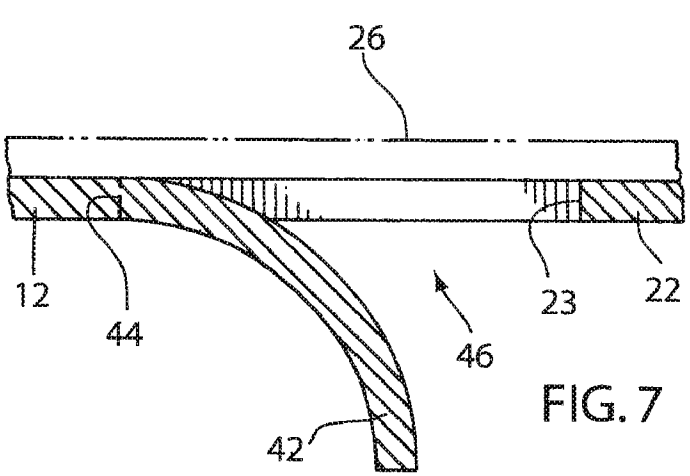
FIG. 7 is a cross-sectional view of the closure of FIG. 2*b*, taken along line 7-7.
Figure 6:
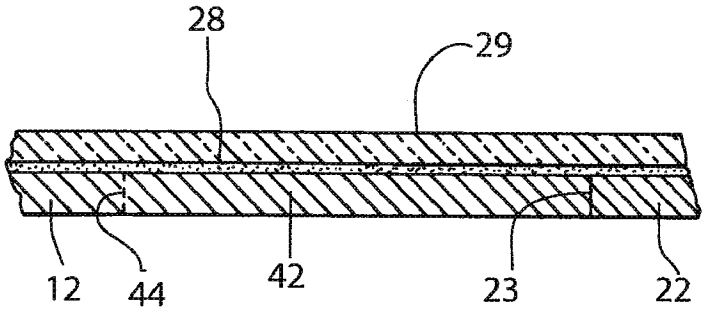
FIG. 6 is an enlarged cross-sectional view of the closure of FIG. 1, taken along line 6-6.
Figure 8:
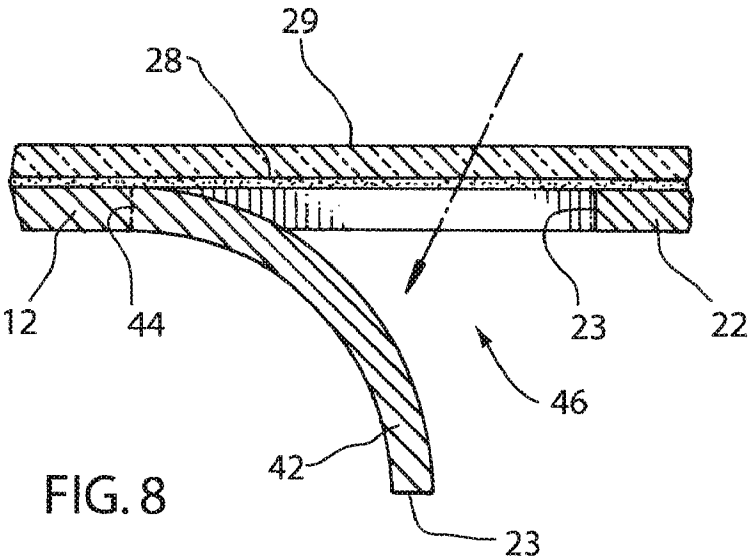
FIG. 8 is a cross-sectional view of the closure similar to FIGS. 6 and 7, depicting a resealed condition of the closure.
Figure 9:
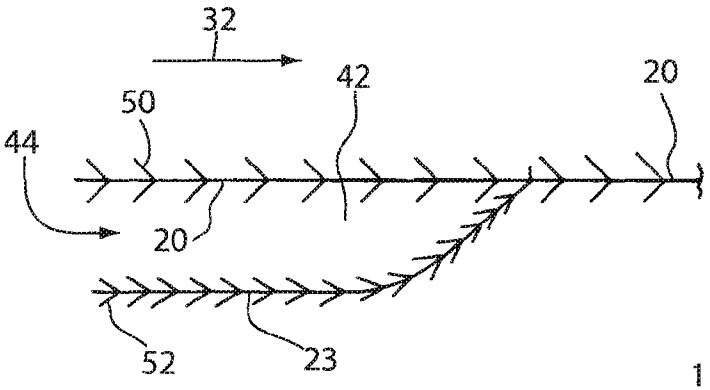
FIG. 9 is a schematic diagram showing the separation of the package integrity feature from the package of FIG. 1, in accordance with the present invention.

As shown in FIGS. 3 and 4, the first panel 22 is separated from the remainder of the inner film layer 12, including the second panel 42, along the first layer tear line 20 and second tear line 23, and remains adhered to the sealing panel 26 as the sealing panel 26 is peeled back in a peeling direction indicated by arrow 32 (FIGS. 2*a* and 4) to open the package 10. After the contents of the package have been accessed and it is desired to reseal the package 10, the sealing panel 26 may be reapplied to the inner film layer 12, approximately in its original position, as depicted in FIG. 5. Because the sealing panel 26 extends beyond the periphery of the first panel 22, the releasable adhesive 28 disposed thereon facilitates the resealing of the package 10 with the first panel 22 positioned over the access opening 24.

In addition, when the sealing panel 26 is peeled away from the inner film layer 12 to separate the first panel 22 for a first time, the second panel 42 is separated from the first panel 22 along second tear line 23. As previously noted, the second panel 42 remains integrally attached to the remainder of the inner film layer 12 at end 44 as the second panel 42 eventually becomes separated from the adhesive coated outer film layer 13 and, in particular, the sealing panel 26, as the sealing panel 26 is pulled back for a first time in direction 32. Referring to the schematic diagram of FIG. 9, as the sealing panel 26 is pulled back for a first time, the first tear line 20 tears successively, as indicated by the series of arrows 50, and the second tear line 23 tears successively as indicated by arrows 52 until the second tear line 23 terminates at the first tear line 20.

The second panel 42, prior to the package 10 being opened for the first time, is in the plane of the remainder of the inner film layer 12 and, thus, extends or is located in what will become the opening 24 after the package 10 is opened.

Although the second panel 42 is shown abutting or adjacent to a side of the opening 24, the second panel 42 can be spaced from the sides of opening 24. After the package 10 has been opened for the first time, the second panel 42 falls away from the plane of the opening and inward toward the center or interior of the package 10.

Figure 2A:
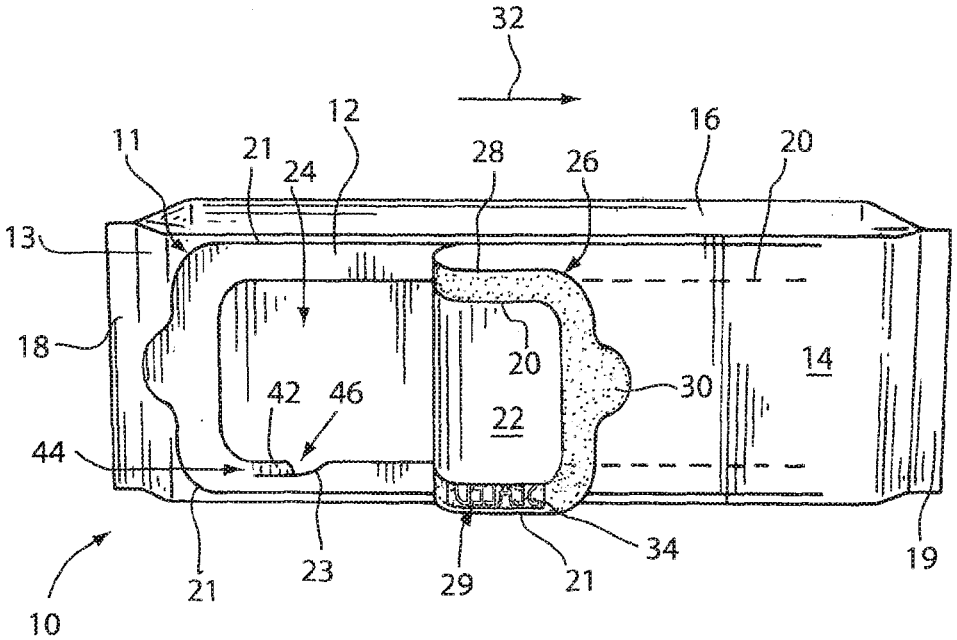
FIG. 2*a* is the package of FIG. 1, shown in a partially opened condition.
Figure 2B:
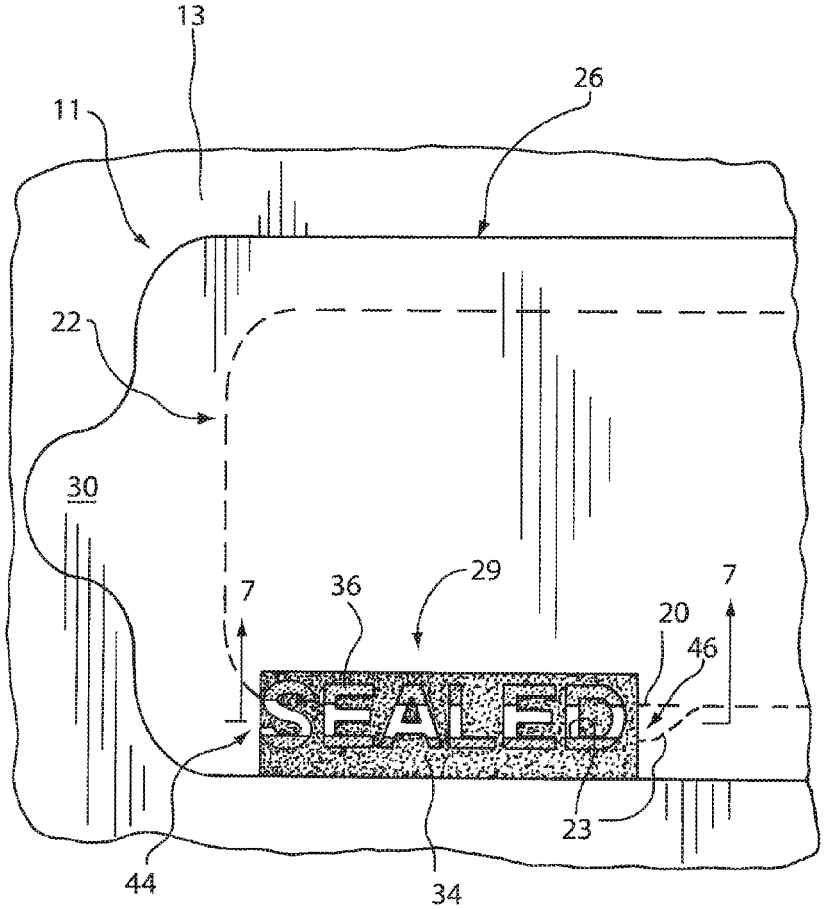
FIG. 2*b* is a partial enlargement of the package of FIG. 1, after the package has been opened and subsequently reclosed.

The second panel 42, along with the see through window portion 29, provides package integrity evidence in the form of a visual indication of an initial opening of the package 10, even after sealing panel 26 is resealed against the inner film layer 12 to reclose the package 10. The visual indication is provided by a portion 34 of the sealing panel 26, shown as black outlined letters for the word "SEALED," and a portion 36 of the inner film layer 12 spanning a portion of the first panel 22 and the second panel 42, shown as being gray which is viewable through the window portion 29, prior to the package 10 being opened for a first time, thus indicating package integrity status as not having been previously opened (FIG. 1). After package 10 has been opened, the second panel 42 will fall into the package 10 while remaining joined to the inner film layer 12 at end 44. Subsequently, following the sealing panel 26 being resealed to the inner film layer 12, over opening 24, void area 46 is viewable as the absence of gray shaded portion 36 observed through the window portion 29, thus indicating package integrity status as having been previously opened (FIG. 2*b*). As a result, the middle portion of the word "SEALED" at void 46 will not be shaded as shown in FIG. 2*b*.

Although portion 36 is depicted and described herein as being gray, it will be clear to one of ordinary skill in the art that the portion 36 as well as the rest of the inner layer 12, can be any color or shade. Further, although the second panel 42 is depicted and described as having dimensions which permit the second panel 42 to lie underneath only the middle portion of the word "SEALED" printed on the sealing panel 26, the second panel 42 could have dimensions which allow the word "SEALED" to lie completely over a relatively larger, second panel, so that after the package has been opened and subsequently resealed, the entire word "SEALED" will be over a relatively larger void area than void area 46, and thus, only the outline of the word "SEALED" will be visible, but the letters themselves will have no part which is shaped or colored.

In addition, although the portion 34 is depicted and described as having the outline of the word "SEALED" formed therein, alternative words, e.g. "UNOPENED" may be substituted. In a further alterative, rather than a word, the portion 34 may be a geometric shape, such as a rectangle, square or circle, which appears filled or solid, prior to the package being opened for a first time, and appears partially or fully voided or unfilled after the package has been opened and subsequently resealed.

While FIGS. 1-9 show and describe closure 11 as forming the opening of a wrapper which defines package 10, the closure 11 may form a top surface of other packages having resealable openings such as those disclosed in U.S. patent application Ser. No. 11/193,613, herein incorporated by reference, and, thus, closure 11 can form a closure over a thermoform tray having a sealing panel 26 as a lidding material over the top of the tray.

Figure 10:
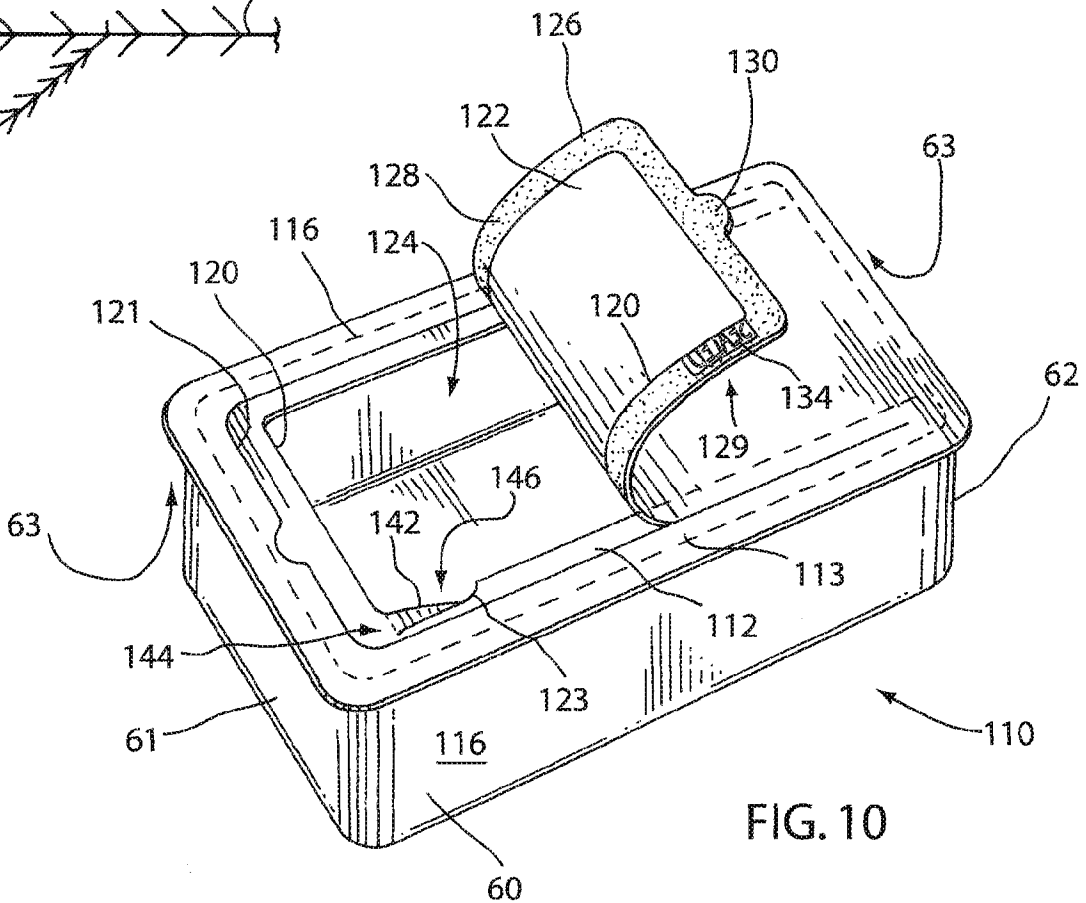
FIG. 10 is a perspective view of another package, including a closure that has been opened, in accordance with the present invention.

Although second panel 42 is depicted and described as being formed in the inner film layer 12 by the first tear line 20 and the second tear line 23, alternatively, a third tear line can be formed in the inner film layer 12 so that the second panel is completely spaced from the opening at the tab portion end of the package as disclosed in the embodiment of FIGS. 10*a* and 10 be of U.S. patent application Ser. No. 11/438,706.

Referring to FIG. 10, like elements to those of the embodiment of FIGS. 1-9 are increased by 100. Package 110 comprises a thermoform tray 60 which forms the sides 116 and ends 61, 62. A two-ply film material comprising an inner film layer 112 and outer film layer 113 are sealed to flange 63 of the thermoform tray 60. Like package 10, pulling back on tab 130 separates the sealing panel 126 from the outer film layer 113 and separates the first panel 122 from both the inner film layer 112 and the second panel 142.

As with package 10, package 110 has a see through window portion 129 formed in the sealing panel 126, lying adjacent or over the second panel 142, such that the second panel 142 is viewable through the window portion 129, prior to package 110 being opened for a first time, thus indicating package integrity as not having being previously opened. After package 110 has been opened for a first time, and subsequently resealed, the absence of the second panel 142 being adhered to the sealing panel 126 will be observable through the window portion 129, thus indicating package integrity status as having been previously opened.

Package 110 can be used for various food items, such as cheese, sliced meats and the like. In addition, package 110 can be used for semi-solid items, such as pudding and yogurt. Although package 110 is depicted as having a rectangular shape, the package 110 can have any shape, including cylindrical and irregular.

The inner and outer film layers 112, 113 may be formed of the same material as layers 12, 13, which includes polypropylene, polyethylene, cellophane or any other polymeric material suitable for forming a package enclosure.

As will be apparent to one of ordinary skill in the art that the present package integrity feature of the present closure offers benefits over prior tamper-evident or package integrity features.

The invention claimed is:

1. A package integrity indicating closure, said closure comprising:

an at least two-ply material comprising a first film layer adhesively joined to a second film layer;

a first tear line formed into said first film layer, defining a first panel for providing an access opening through said first film layer when separated from said first film layer along said first tear line, and a second tear line formed into said first film layer and directly terminating at said first tear line to thereby define a second panel for indicating an initial opening of the closure when the second panel is separated from said first panel along said first tear line;

said second film layer completely covering the first panel and the second panel of the first film layer;

said second film layer including a resealable adhesive layer for releasably adhering said sealing panel to said first film layer wherein said sealing panel is separable from said first film layer and said second panel to expose the access opening; and wherein the second panel provides a visual indication that the closure has been opened after said sealing panel has been peeled back from said first film layer for a first time.

2. The closure of claim 1, wherein said second panel is constructed to fall away from a plane defined by said first film layer after the second film layer is peeled back from said first film layer for a first time.

3. The closure of claim 1, wherein the second film layer includes a third tear line defining at least in part said sealing panel.

4. The closure of claim 1, wherein the visual indicator comprises coordinated indicia having a first portion on the sealing layer and a second portion on the second panel, wherein prior to initial opening the coordinated indicia appears complete and after initial opening the coordinated indicia appears incomplete, thereby indicating previous opening.

5. The closure of claim 1, wherein said sealing panel comprises of a see through window portion allowing visual observation of said second panel of said first film layer.

6. The closure of claim 5, wherein said sealing panel see through window portion lies over said second panel of said first film layer, prior to closure being opened for a first time.

7. An integrity indicating closure for a container comprising:

an at least two-ply material comprising an inner layer adhesively joined to an outer layer and forming a top of the container, said inner layer having a first panel and a second panel, said outer layer having a sealing panel formed therein which completely covers the first panel and the second panel of the inner layer, said first panel and said sealing panel being permanently joined to each other to provide an access opening into the container such that when the sealing panel is pulled from the inner layer the first panel of the inner layer is pulled back with the sealing panel, thereby opening the access opening, the second panel directly abutting the first panel prior to initial opening of the access opening; and a releasable adhesive provided around a perimeter of said sealing panel for adhering said sealing panel to said inner layer and said second panel, said sealing panel being releasable from said inner layer and separable from the second panel by pulling the sealing panel back in a peeling direction and reclosable against said top to seal said opening when said sealing panel is moved back against said top, whereby after closing, the second panel is separated from the sealing panel thereby providing a visual indication that the integrity closure has been opened.

8. The integrity indicating closure of claim 7, wherein said second panel is integrally formed with said inner layer.

9. The integrity indicating closure of claim 7, wherein said second panel is spaced from opposing sides of said opening.

10. The integrity indicating closure of claim 7, wherein said second panel is constructed to fall into said container when said sealing panel is peeled back for a first time.

11. The integrity indicating closure of claim 7, wherein said sealing panel comprises a material allowing visual observation of said second panel of said inner layer.

12. The integrity indicating closure of claim 7, wherein said sealing panel comprises a see through window portion lying over said second panel of said inner layer, prior to said closure being opened for a first time.

13. The integrity indicating closure of claim 7, wherein said second panel falls away from the plane of said opening, after the sealing panel is peeled back from said inner layer for a first time.

14. The integrity indicating closure of claim 7 wherein the sealing panel is formed in the outer layer.

15. The integrity indication closure of claim 7, wherein the visual indication comprises coordinated indicia having a first portion on the sealing layer and a second portion on the second panel, wherein prior to initial opening the coordinated indicia appears complete and after initial opening the coordinated indicia appears incomplete, thereby indicating previous opening.

16. The integrity indicating closure of claim 7, wherein the second panel abuts said first panel prior to initial opening.

17. A package integrity indicating closure, said closure comprising:

an at least two-ply material comprising a first film layer adhesively joined to a second film layer;

a first tear line formed into said first film layer, defining a first panel for providing an access opening through said first film layer when separated from said first film layer along said first tear line, and a second tear line formed into said first film layer and directly terminating at said first tear line to thereby define a second panel having an inner edge coextensive with the first panel prior to initial opening, the second panel indicating an initial opening of the closure when the second panel is separated from said first panel along said first tear line;

said second film layer completely covering the first panel and the second panel of the first film layer;

said second film layer including a resealable adhesive layer for releasably adhering said sealing panel to said first film layer wherein said sealing panel is separable from said first film layer and said second panel to expose the access opening; and wherein the second panel provides a visual indication that the closure has been opened after said sealing panel has been peeled back from said first film layer for a first time.

* * * * *

UNITED STATES PATENT AND TRADEMARK OFFICE

CERTIFICATE OF CORRECTION

PATENT NO. : 8,308,363 B2
APPLICATION NO. : 11/500497
DATED : November 13, 2012
INVENTOR(S) : Vogt et al.

It is certified that error appears in the above-identified patent and that said Letters Patent is hereby corrected as shown below:

In Column 7, Line 11, in Claim 6, delete "prior to" and insert -- prior to said --.

In Column 8, Line 11, in Claim 15, delete "indication" and insert -- indicating --.

Signed and Sealed this
Fifth Day of March, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,308,363 B2
APPLICATION NO. : 11/500497
DATED : November 13, 2012
INVENTOR(S) : Vogt et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1525 days.

Signed and Sealed this
Eleventh Day of November, 2014

Michelle K. Lee

Michelle K. Lee
*Deputy Director of the United States Patent and Trademark Office*